US006802166B1

(12) United States Patent
Gerhard

(10) Patent No.: US 6,802,166 B1
(45) Date of Patent: Oct. 12, 2004

(54) COMPONENT OR ASSEMBLY OF SAME AND FIXING CLIP THEREFOR

(75) Inventor: Dirnberger Gerhard, Strasswalchen (AT)

(73) Assignee: M. Kaindl, Walser Weg (AT)

( * ) Notice: Subject to any disclaimer, the term of this patent is extended or adjusted under 35 U.S.C. 154(b) by 0 days.

(21) Appl. No.: 10/031,185

(22) PCT Filed: May 24, 2000

(86) PCT No.: PCT/AT00/00145

§ 371 (c)(1),
(2), (4) Date: May 13, 2002

(87) PCT Pub. No.: WO01/07729

PCT Pub. Date: Feb. 1, 2001

(30) Foreign Application Priority Data

Jul. 23, 1999 (AT) ..... 1278/99

(51) Int. Cl.[7] ..... E04F 15/22

(52) U.S. Cl. ..... 52/403.1; 52/480; 52/506.05; 52/712

(58) Field of Search ..... 52/403.1, 480, 52/506.05, 589.1, 592.1, 591.5, 391, 698, 702, 712, 715

(56) References Cited

U.S. PATENT DOCUMENTS 5,706,621 A * 1/1998 Pervan ..... 52/403.1
6,532,709 B2 * 3/2003 Pervan ..... 52/403.1

FOREIGN PATENT DOCUMENTS

| | | |
|---|---|---|
| AT | 401 951 | 1/1997 |
| CH | 595 526 | 2/1978 |
| CH | 601 589 | 7/1978 |
| DE | 39 29 252 | 3/1991 |
| DE | 297 10 175 | 8/1997 |
| DE | 197 09 641 | 9/1998 |
| EP | 0 855 482 | 7/1998 |
| WO | 84/02155 | 6/1984 |
| WO | 93/13280 | 7/1993 |
| WO | 97/47834 | 12/1997 |

* cited by examiner

*Primary Examiner*—Carl D. Friedman
*Assistant Examiner*—Jennifer I. Thissell
(74) *Attorney, Agent, or Firm*—Renner, Otto, Boisselle & Sklar, LLP

(57) ABSTRACT

The invention relates to wood-product components (1, 2) which are provided, along their longitudinal edges (7) with matching projections and/or recesses by which they are joined together, wherein two recesses in the form of grooves are provided in the underside (15) of each component (1, 2), for accommodating retaining elements (10, 12) of at least one clip (11) arranged under the components (1, 2);

wherein the retaining elements (10, 12) extend upward from the clip base body (17);

wherein one of the two retaining elements (10) can be engaged with an edge-proximate inside surface (13) of a recess (8, 9') of one component (1), and the other retaining element (12) can be engaged with an edge-proximate inside surface (20) of a recess (8', 9) of the adjoining component (2), and wherein one of the retaining elements (10) is a flange element extending upward.

According to the invention, the components are characterized in that the other retaining element, adapted to engage in the recess (8', 9) of the adjoining component (2), is formed by a resilient detent (12) which in unstressed position extends upward from the clip base (17) in the direction obliquely to the plane defined by the edges (7) of components (1, 2).

22 Claims, 2 Drawing Sheets

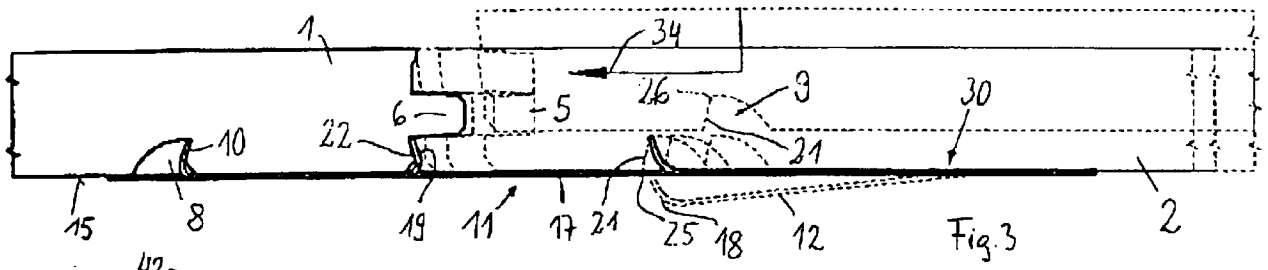
Fig.3
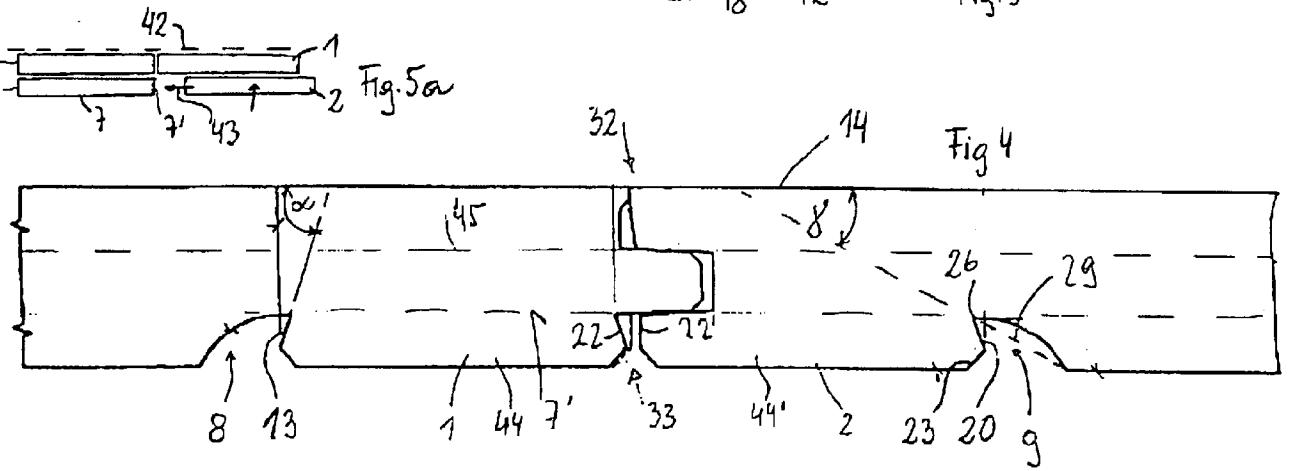
Fig 4
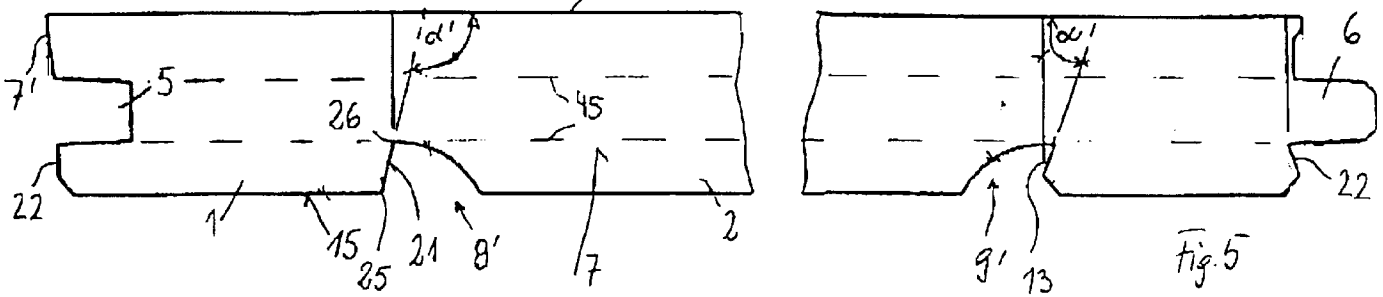
Fig.5
Fig.5a

COMPONENT OR ASSEMBLY OF SAME AND FIXING CLIP THEREFOR

This application is a 371 of PCT/AT00/00145 filed May 24, 2000.

The invention relates to structural members or components, an arrangement of such components, and clips for holding the components together. The components, which can be made of wood, wood products or wood-based products, are in the form of panels or planks that can be coated on the top surface and/or underside with plastic laminates, etc. The components have use as panels, sheets, floor panels, wooden siding and cladding, etc.

BACKGROUND OF THE INVENTION

Wood-product arrangements and components thereof are known from German Utility Model DE 297 10 175 U1.

SUMMARY OF THE INVENTION

The present invention provides for the simple manufacture of such components and clips as well as to allow that with the clips, the components can be laid and joined together easily, quickly and with precision. The invention facilitates the glueless, quick and durable laying of a floor and its easy and non-destructive dismantling.

In accordance with the invention, a clip for holding together components in the form of panels or planks that have longitudinal recesses spaced inwardly form longitudinal edges thereof, includes a detent having a free end section that may include a locking element. The free end section extends, in an unstressed position, upward from a clip base, in a direction obliquely to the plane defined by the edges of the components, and can be elastically deflected downward. The characteristics of the invention, the simple design of the clip and the easy manufacture of the components ensure that the clip can be applied quickly, that be joined together simply and with precision, and that the union is good and firm. If the components according to the invention are laid and glued as well, no clamping means are necessary, since the clips hold the components under tension until the glue or other adhesive is cured.

An advantageous connection between the clip and a component to which an adjacent component is to be joined, is produced when the clip base carries between an upward extending flange element and the detent, another flange element extending upward, which can be applied against the edge of the component accommodating the upward extending flange element. If need be, the two flange elements can be inclined toward each other and with a component face surface enclose the same angle between 60° and 80°. The edge area of the component edge against which the flange element can be applied, can be inclined toward the surface of the component at the same angle as the flange element.

A precise and firm joinder is accomplished when the detent is tilted into the plane of the clip base body, and the locking element of the detent, with a face surface of the component, enclose an angle which corresponds to the angle enclosed by the edge-proximate inside surface with the surface of the component; or when the edge-proximate inside surface of one of transverse recesses in the component is applied against the detent or its locking element, and the locking element of this detent is inclined in the direction opposite to that of the face surface of the components, that they each enclose different angles, whereby the outside end edge of the inside surface of the recess is closer to the transverse edge of the corresponding component than the inside end edge.

A simple, strong clip, which holds the components well in their position, results when the detent, the flange element and the additional flange element are punched out of the clip base which is made of spring-elastic metal.

Advantageous features for laying the components with precision and for ensuring a firm fit of the clips are the edges of the components, which may have a plane underside for lying on a plane underlay, adjoining each other at surface level but having a space between each other at a bottom level; and/or from at least one of the edges of a component, two legs extend, forming a groove between them, and that into this groove a tongue coming from one of the edges of the other component is inserted, whereby, if need be, the leg at an underside level is shorter than the leg at a top surface level.

The invention also relates to a clip for components or for an arrangement of the kind mentioned above, which is easy to manufacture and can join the components firmly together. The clip can be provided with at least two upward projecting retaining elements, one of which is a flange element bent upward from the clip base body. The other retaining element can be formed by an elastically or resiliently displaceable detent extending upward, whereby the detent, which may have on a free end section an upward extending locking element, may in unstressed position extend from the clip base body diagonally upward in the direction of the retaining element. The clip body, between the upward-extending flange element and the detent, can have an additional flange element that is also extending upward.

Advantageous embodiments of the invention are explained in the following description, in the claims and in the drawings.

BRIEF DESCRIPTION OF THE DRAWINGS

Examples of the invention are described in detail with reference to the drawings, where

FIG. 3 shows a diagrammatic side view of two components joined longitudinally according to another embodiment of the invention;

FIG. 4 shows how two components are joined, at their narrow ends;

FIG. 5 shows a diagrammatic view of a component, as seen from its longitudinal side; and FIG. 5*a* shows in schematic view how two components are joined by their end edges.

DETAILED DESCRIPTION

Figures 1, 1A, 1B, 2:
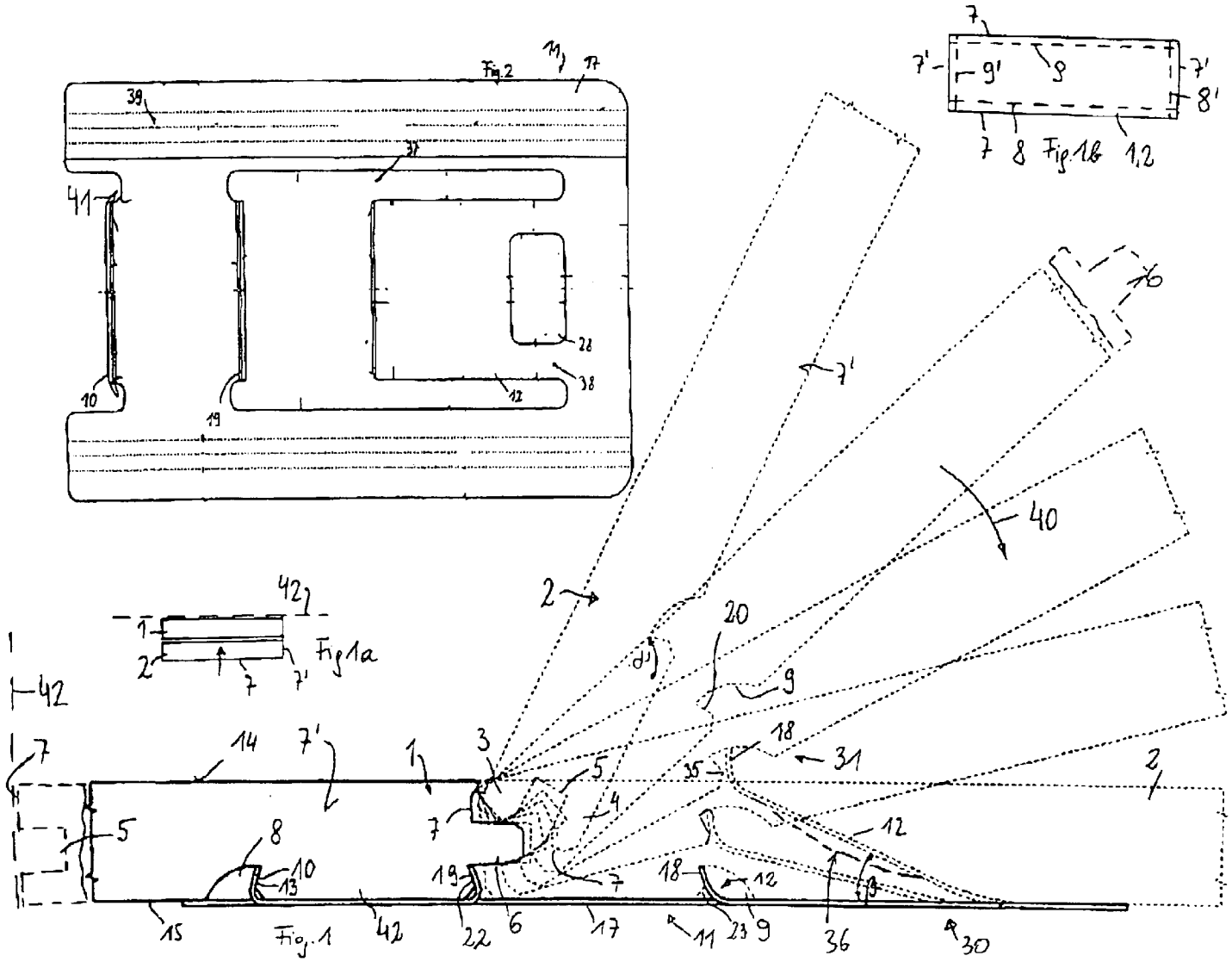
FIGS. 1 and 1*a* show the longitudinal joining of two components in a diagrammatic sectional view.
FIG. 1*b* shows the bottom view of a component.
FIG. 2 shows a top view of a clip.

FIG. 1 shows a first embodiment of the invention, according to which two elongated components 1 and 2, which are rectangular when seen in a top view, such as floor panels, are joined together lengthwise, and are disposed on the floor or on a support not shown, and are aligned along a wall 42 as shown in FIG. 1*a*.

The left component 1, which is shown only partly in FIG. 1, is provided, on its right edge 7, with a projection in the form of a tongue 6 and, on the other edge, shown only in phantom lines and abutting against the wall 42, with a recess in the form of a groove 5. This component 1 is joined to component 2 which is provided on its edge 7 shown in the drawing with a recess in the form of a groove 5, bordered by two legs 3, 4, and on its opposite edge with a tongue 6 shown in broken lines. Instead of these projections and recesses, it is also possible to form stepped shoulders, keys, etc. or several parallel tongues and grooves. The underside 15 of each of the components 1, 2 is provided, at portions near each of its two longitudinal edges, and near each of the transverse end sections, with a recess 8, 9 or 8', 9', which extends substantially parallel to the edge 7 or 7' and serves to accommodate retaining elements in the form of flange elements 10 and detents 12, as shown in FIG. 1*b*. The flange element 10 and the detent 12 are formed from a clip base body 17 of a clip 11, and they engage in recesses 8, 9 or 8', 9'. In FIG. 1, components 1, 2 are shown as seen in the direction as viewed in the direction away from their transverse, short end edges 7', and the cross section of the recesses 8, 9 extending parallel to the long edges of components 1, 2 can be seen.

Clip 11 is brought in position on or snapped onto component 1 by means of flange element 10, which is bent upward from the clip base 17, and by means of another flange element 19, which can be applied to the longitudinal edge 7 of component 1 in an edge portion 22. The edge-proximate inside surface 13 of recess 8 and the edge portion 22 together with the flange elements 10 and 19 that can be applied to these surfaces are disposed at a corresponding slant in relation to the above, or the angle of incline of contact surfaces 13, 22 is adapted to this dovetailed section 42 of component 1, so that clip 11 can be snapped into this dovetailed part and held in position there.

In the sector referred to as 30 in FIG. 1, a resilient detent 12 extends in unstressed position from the clip base edge 17 upward in the direction oblique to the plane formed by the abutting edges 7 of components 1 and 2. Advantageously, it can be provided in this case that detent 12 runs obliquely upward from clip base body 17 at an angle β between 10° and 30°, preferably between 15° and 25°.

The detent 12 is provided at its forward portion with a locking element 18, which is curved or bent upward and can be placed so that its whole surface or its end or an end rim can be applied to the edge-proximate inside surface 20 of recess 9, and so that in applied position it exerts a spring action upon the downward-pivoted component 2 via this inside surface 20 in the direction toward the component 1.

In FIG. 1 it is shown how the components 1, 2 are joined together. After the clip 11 was initially fastened to component 1, component 2 is placed from the top, or at an angle of about 60° to 80° from the top, by edge-proximate leg 3 of groove 5 onto the tongue 6 of component 1, and then, while component 2 is simultaneously pivoted downward, groove 5 is pushed onto tongue 6. During this pivoting movement, as shown by arrow 40, recess 9 is brought close to the upwardly projecting locking element 18, and locking element 18 enters recess 9, as shown by reference 31. When component 2 is lowered further, locking element 18 comes in contact with the inside surface 20 of recess 9 and pushes component 2 in the direction of the other component 1. At the same time, component 2 is also pushed in that direction by hand, so that groove 5 fully snaps onto tongue 6. Eventually, component 2 is pivoted onto the plane of component 1 and, as indicated in FIG. 4 by reference 32, the upper edge areas of components 1, 2 adjoin each other without gap and are under pressure from locking element 12. In section 33, the two opposite edge areas 22 have a space between them at bottom level, especially to make room for the additional flange element 19 of clip 11 or to allow the attachment or application of the element to one of the edge areas 22 at bottom level. This space is also used to compensate for uneven parts of the floor and to prevent surface 14 from cracking.

When the locking element 18 has entered recess 9, the rounded profile of the locking element 18 contacts edge 35 of recess 9. When component 2 is pivoted further, locking element 18 snaps into final position about this edge 35, where surface 20 is pressed downward and in the direction of component 1 by locking element 18. Since the edge-proximate inside surface 20 is provided with an undercut or beveled configuration, the joint is prevented from becoming loose by itself.

Advantageously, detent 12, as shown by reference 36, is somewhat concavely curved downward, to facilitate the bending and snapping-back of the resilient detent 12.

In the embodiment shown in FIGS. 1 and 4, the two recesses 8, 9 provided in each of the two components 1 and 2 are mirror-symmetrical. If edge area 22 of the two components 1 and 2 at bottom level, which are opposite each other, also have mirror-symmetrical abutting surfaces, it is possible to apply clip 11 either to the edge portion of component 1 which is provided with tongue 6, or to the side section of component 2 which is provided with groove 5. The preferred method is to apply clip 11 to the edge portion of a component 1, 2 provided with tongue 6, since it is easier to attach groove 5 to tongue 6 while pivoting component 2 than in reverse order.

The position of clip 11 also depends on the incline of edge area 22; clip 11 will fit more firmly to component 1 if edge area 22 has an appropriate incline.

FIG. 3 shows a schematic cross section of an embodiment or method of the invention, according to which a component 2 is joined to component 1 from the side by pushing it horizontally. In principle, this method can be used to join the longitudinal edges of components 1 and 2 according to FIG. 1, but advantageously it is used for joining the transverse narrow end edges 7' of the two components 1, 2. In this case, either the already laid component 1 can be slightly lifted with its attached clip 11, or else component 1 with clip 11 can be placed on a soft, resilient base such as a sound insulation underlay, to allow detent 12 to be moved or deflected downward. As soon as component 2 is moved toward component 1 in substantially horizontal direction as shown by arrow 34, the detent with locking element 18 is pushed below the plane of clip base body 17, and groove 5 can be pushed onto tongue 6. As soon as groove 5 has been pushed onto tongue 6, the edge-proximate inside surface 21 of recess 9, which slants diagonally toward the top right, comes to rest above locking element 18, then locking element 18 snaps into or enters recess 9, abuts resiliently against the inside surface 21 and thus prevents the unlocking of the tongue-and-groove joint of component 2 and component 1.

To allow the sliding of a component 2 as described in connection with FIG. 3 beyond the pushed-down detent 12, in particular without damaging locking element 18, the aforesaid locking element 18 is deflected at such a curve that it cannot hook onto component 2. Furthermore, detent 12 is carefully deburred to prevent it from becoming caught.

FIG. 2 shows a top view of a clip 11 according to the invention. Clip 11 has an approximately rectangular circumference, and advantageously it is produced by stamping out a thin, resilient material. The flange element 10 is bent upward from clip base body 17. It is advantageous when in the lateral end sections of flange element 10 and/or the other flange element 19, engagement elements 41, in particular hooked or pointed deflections, are provided. This prevents clip 11, which snaps into section 42, from sliding in lateral direction. Located opposite flange element 10 is the other flange element 19, which is also bent upward from clip base body 17. A stamped-out area 37 limits the other flange element 19 and detent 12. It is advantageous when at least one recess 28 is formed in the transitional or joint area 38 between the detent 12 and the clip base body 17. The spring force of detent 12 can be adjusted to the size, especially the width, of recess 28.

It is advantageous if the clip 11 is symmetrically designed so that its center plane is perpendicular to the direction of the flange elements 10, 19. It can also be provided that in a clip base body 17, a multiple of flange elements 10, 19 and/or detents 12 are formed, lying side by side in a row. It is also possible to have a combination of several flange elements 10 or 19, which lie opposite each other, perhaps in staggered fashion, and one or more detents 12.

The spring action of detent 12 prevents components 1 and 2 from moving apart; however, due to the spring action, the components are allowed a certain degree of expansion, particularly in response to moisture.

FIG. 4 shows recesses 8, 9 of two components 1, 2 joined to each other along their longitudinal edges 7; the abutting planes of these recesses are mirror-symmetrical. It is evident that the edge-proximate inside surface 20 of recess 9, against which detent 12, (which extends diagonally upward) can abut, especially with its bent-away or curved locking element 18, encloses an angle ($\alpha$) of less than 90° with surface 15 of component 1, preferably an angle between 6020 and 80°, and that the edge-proximate inside surface 13 of recess 8, against which flange element 10 can abut, encloses the same angle ($\alpha'$) with surface 14. Insofar as edge area 22' has the same incline as edge area 22, either area 44 or 44 wherein can be chosen for snapping a clip 11 into flange elements 10 and 19.

In FIGS. 4 and 5, the horizontal lines 45 indicate the path of a groove or tongue on the narrow or transverse edges 7' or on the longitudinal edges 7 of components 1, 2. To keep the drawing simple, this indication of a groove or tongue in the respective edges of the components was omitted in FIGS. 1 and 3. In practice, a groove is provided on the longitudinal and transverse edge of a component, while a tongue is provided on the other transverse edge, so that the components can be laid in such a way that they are joined either by their longitudinal edges or by their narrow edges; the clips according to the invention can be used to produce a joint on the longitudinal edges as well as on the short end edges.

As shown in FIG. 5*a*, it is advantageous to begin by laying a component 1 by one of its edges, preferably the grooved longitudinal edges 7, against a wall 42 of a room and, as shown in FIGS. 1 and 5*a*, by connecting another component 2 to its tongued edge. When another row of components 1, 2 is laid beside it, also extending out from wall 42, it becomes necessary to join components 1, 2 of the new row to the components of the previously laid row along their narrow edges. This is accomplished by means of the recesses 8', 9' in components 1, 2 which extend along the end edges 7', as shown in FIGS. 1*b* and 5, or by means of the method described in connection with FIG. 3. As soon as two components 1, 2 of a new row, as shown on the right in FIG. 5*a*, are joined either by pivoting in accordance with FIG. 1 or by pushing-in according to FIG. 3, the component of the new row to be added can be pushed in the direction of the end edge of the corresponding already laid component. This component 2, which can be pushed as indicated by arrow 43, is already held on its longitudinal edge by clips 11 and can no longer be moved away from the already laid component 1. Before pushing in the direction of the narrow edge 7' of the already laid component 1, at least one clip 11 was fastened to narrow edge 7' of the laid component, and this clip is projecting from said narrow edge 7'; as indicated by arrow 43 in FIG. 5*a*, component 2, which is to be newly inserted, is pushed over detent 12—or according to FIG. 3 over the upward-extending locking element 18 of detent 12—and thus fixed.

It was found that it is advantageous when recesses 8, 9, which extend parallel to the longitudinal edges 7 of components 1, 2, are mirror-symmetrical and provided with undercut inside surfaces 13 and 20. On the other hand, it was found that it is advantageous when recesses 8' 9' which extend parallel to the end edges 7' of components 1, 2, are not mirror-symmetrical but have comparable inclined inside surfaces 13, 21. The inside surface 13 of recess 9', for accommodating flange 10 of clip 11, is undercut, as shown in FIG. 5, while the inside surface 21 of the recesses which extend along the opposite transverse edge 7' is not undercut.

Recess 8' along transverse edge 7' has the same cross section as recess 9 in FIG. 3, where, however, it was described as a special case or special embodiment.

To allow locking element 18 to snap into recess 8', it is necessary that the inside surface 21 has at least a vertical position in relation to the underside 15 of component 1; however, it is advantageous, especially in view of the fact that the end of detent 12 describes a circular path when pivoted, and also to ensure that detent 12 abuts correspondingly to inside surface 21, that inside surface 21 describes a corresponding angle ($\alpha'$) in relation to detent 12 or its area 30. This angle also ensures that, should the components shrink or expand, the detent or its contact surface or edge sits firmly on the inside surface, or that this inside surface can slide up and down on this contact surface exerting a pressure.

It can be provided, for the formation of edge 35 or to facilitate the snapping-in of locking element 18 in an embodiment of clip 11 according to FIG. 1, that the edge-proximate area of recess 9, which accommodates detent 12, is beveled, reduced in size or rounded, as indicated by reference 23.

In FIG. 4, it is indicated that the edge-distant inside surface 29, remote from the end edge, of recess 9 for detent 12 is inclined at an angle $\gamma$ between 15° and 40°, preferably between 20° and 35°, in relation to surface 14. In principle, the remote inside surface 29 may have various shapes; it must be formed in such a way that it does not counteract the entry of locking element 18 of detent 12 in recess 8 while component 2 is pivoted.

Advantageously, recesses 8, 9, 8', 9' or grooves 5 and tongues 6 are cut out, in particular milled out, from components 1, 2. Finishing coats for components 1, 2 on top surface 14, underside 15 and in some cases on edges 7 are not shown and can be chosen at random. Components 1, 2 could be made of any material that can be machined in such a way that recesses 8, 9, 8', 9' can be produced easily and with precision.

The clips 11 are punched-out parts which in particular can be manufactured in one production run. The clip base body 17 and/or the detent 12 can be reinforced by means of appropriate inserts or beading.

The angles at which the flange elements 10, 19, the detent 12, the inside surfaces 20, 21 or 13, and the edge area 22 are inclined in relation to surface 14 of components 1, 2, can be varied from section to section; these angles should mainly ensure the easy application or snapping of clips 11 to the appropriate components 1, 2, and ensure the trouble-free penetration of locking element 18 into recess 9 while providing a firm hold.

The number of clips 11 to be attached along one of the edges 7, 7' of components 1, 2 is optional. The clips are fastened at intervals of approximately one every 60 cm.

What is claimed is:

1. Components in the form of panels or planks, in combination with at least one clip, whereby the components can be assembled in side-by-side relationship and held together by the clip, wherein longitudinal edges of the components have matching projections and/or recesses by which the components can be joined;

wherein each component has formed in the underside thereof respective longitudinal recesses extending, parallel to the longitudinal edges;

wherein the clip has a base and first and second retaining elements extending upwardly from the base for engaging in the longitudinal recesses of the components at edge-proximate inside surfaces of the recesses to hold and press the components together; and wherein the second retaining element is in the form of a detent having a main portion extending obliquely from the base and terminating at an upturned locking element, and the main portion is resiliently displaceable downwardly into the plane of the base.

2. A combination according to claim 1, wherein the main portion of the detent extends from the base in a cantilever like manner for resilient downward swivel-like movement into or below the plane of the clip base.

3. A combination according to claim 1, the longitudinal recesses are mirror-symmetrical in relation to the longitudinal center plane of the corresponding component.

4. A combination according to claim 1, wherein the clip base has a third retaining element extending upwardly therefrom and located between the first and second retaining elements, which third retaining element is arranged for engaging a longitudinal edge of one of the components when the first retaining element is engaged in the longitudinal recess adjacent the longitudinal edge.

5. A combination according to claim 1, wherein the first, second and third retaining elements are punched out of the clip base which is made of spring-elastic metal.

6. A combination according to claim 1, wherein the edge-proximate inside surfaces of the each longitudinal recess and an upper surface of the component enclose an angle smaller than 90°.

7. A combination according to claim 1, wherein when the main portion of the detent is displaced into the plane of the clip base, the locking element of the detent and the base enclose an angle which corresponds to the angle enclosed by the edge-proximate inside surface with the upper surface of the component.

8. A combination according to claim 1, wherein the edge-proximate inside surface of the recess intended to receive the second detent forms with a bottom surface of the component a corner surface that is sloped opposite the edge-proximate inside surface.

9. A combination according to claim 1, wherein each component has transverse recesses extending parallel to transverse edges of the component, at least one of the transverse recesses has an edge-proximate inside surface extending from a bottom surface of the component to a height equal the height of the locking element relative to the base when the main portion is displaced downwardly into the plane of the base, and the outside end edge of the edge-proximate inside surface of said one recess is closer to the transverse edge of the corresponding component than the inside end edge thereof.

10. A combination according to claim 1, wherein the edge-proximate inside surface of the longitudinal recesses is rounded or is disposed at an angle of incline between 15° and 40° in relation to an upper surface of the component.

11. A combination according to claim 1, wherein the edges of the components have lower regions thereof that define therebetween a space when the components are held together by the clip.

12. A combination according to claim 1, wherein the first and second retaining elements are spaced apart along a longitudinal axis of the clip that divides the clip into opposite halves, and the opposite halves are mirror-symmetrical in relation to the longitudinal axis of the clip.

13. A combination according to claim 1, wherein the first and second retaining elements are arranged in a row that extends parallel to a longitudinal axis of the clip.

14. According to claim 1, the main portion of the second retaining element is concavely bent downward.

15. A combination according to claim 1, wherein the main portion of the second retaining element is joined to the clip base at a connection area and the connection area has at least one recess is formed therein.

16. A combination according to claim 1, wherein at least one of the edges of each component has two legs forming a groove between them, and the other edge of the component has a complementary tongue projecting therefrom for mating with the groove in a next adjacent component.

17. A combination according to claim 1, the main portion of the detent extends upward from the clip base at an angle of 10° to 30°.

18. A combination according to claim 1, wherein the main portion of the detent is curved and ends at the locking element.

19. An assembly comprising the combination according to claim 1, wherein the components are assembled in side-by-side relationship and held together by the clip.

20. A clip for components in the form of panels or planks that can be assembled in side-by-side relationship and held together by the clip, said clip comprising a base and first and second upward projecting retaining elements wherein the first retaining element is a flange element bent upward from the clip base, and the second retaining element is formed by a resiliently displaceable detent extending upward from the base, the detent having a main portion extending obliquely from the base and terminating at an upturned locking element, and the main portion is resiliently displaceable downwardly into the plane of the base, and wherein the clip base has a third retaining element extending upwardly therefrom and located between the first and second retaining elements, the third retaining element being arranged in opposition to the first retaining element for engaging a longitudinal edge of one of the components when the first flange element is engaged in a longitudinal recess adjacent the longitudinal edge.

21. A clip according to claim 20, wherein the detent can be moved elastically from its undisplaced position downward through the said clip base.

22. A clip according to claim 20, wherein the third retaining element is a flange element bent upwardly from the base, and either one or both flange elements have at lateral end sections bent engagement elements.

* * * * *